United States Patent [19]

Yamamoto

[11] Patent Number: 4,879,495

[45] Date of Patent: Nov. 7, 1989

[54] ILLUMINATION CONTROL METHODS AND MEANS

[76] Inventor: Yujiro Yamamoto, 1201 Via La Jolla, San Clemente, Calif. 92672

[21] Appl. No.: 915,781

[22] Filed: Oct. 6, 1986

[51] Int. Cl.[4] ..... H05B 37/00

[52] U.S. Cl. ..... 315/362; 315/315; 315/322; 307/114

[58] Field of Search ..... 315/315, 321, 360, 361, 315/362, 322; 307/114

[56] References Cited

U.S. PATENT DOCUMENTS 3,514,626 5/1970 Platzer ..... 307/114

3,860,910 1/1975 Hudson ..... 307/114

4,410,839 10/1983 Dodkin ..... 315/362

*Primary Examiner*—James J. Groody

*Assistant Examiner*—Mark R. Powell

[57] ABSTRACT

A system and method for altering the amount of electrical energy supplied to a plurality of fluorescent lamps, has a first switch connected in series between a source of electrical energy and a plurality of lamps connected in parallel. The first switch may be a simple ON-OFF, single pole- single throw wall switch. A second switch is connected in series with less than all of the lamps and is an electrically actuated toggle switch which responds to actuation of the wall switch. Multiple actuation of the wall switch permits turning all lights on or off or some on while others are off.

5 Claims, 1 Drawing Sheet

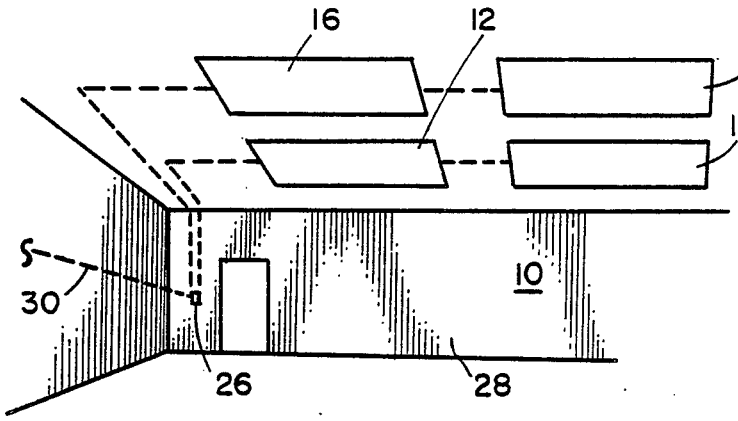
Fig. 1
Fig.2
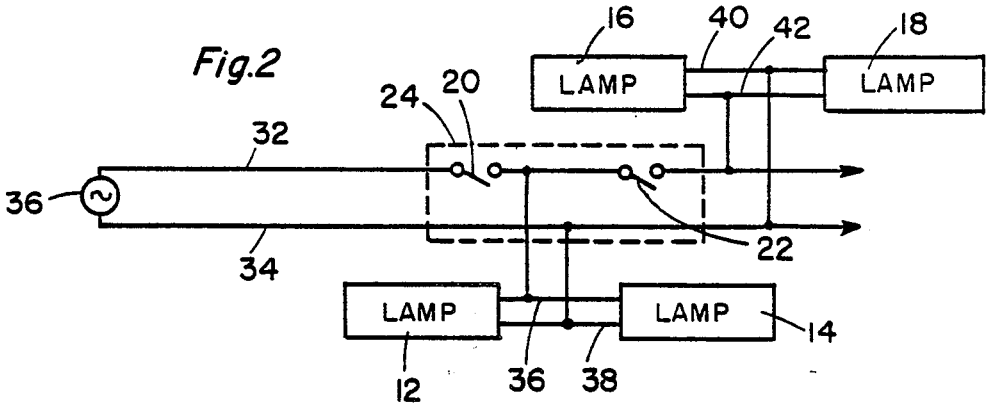
Fig.3
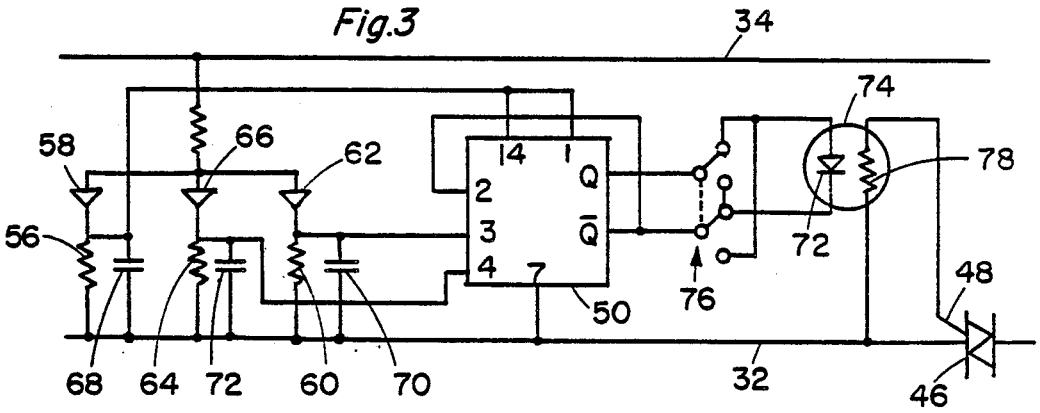
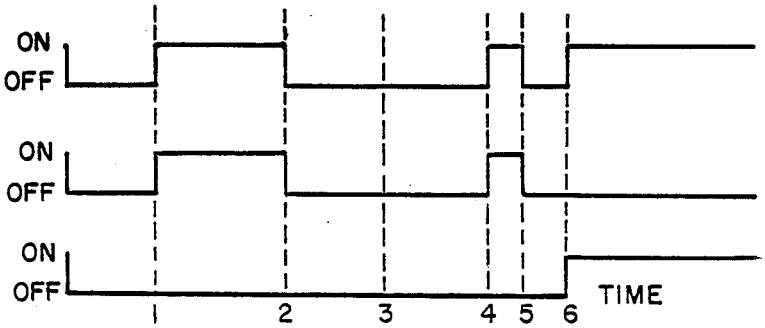
Fig. 4

ILLUMINATION CONTROL METHODS AND MEANS

TECHNICAL FIELD

This invention relates to methods and apparatus for controlling illumination levels particularly levels of space illumination.

BACKGROUND ART

There are a number of circumstances in which it is desirable to have the facility to control the level of illumination in a given space by selectively turning off some of the sources of overhead illumination for that space. Thus for example, it may be desirable, and often is a requirement of local ordinance, that the level of illumination in office buildings be reduced for the period at night when the offices are not occupied. It may be desirable to increase or decrease the number of lamps that are illuminated at certain times of the day or in connection with particular activities in a computing room, for example, to reduce glare on monitor tube faces.

It is relatively easy to incorporate provisions for accomplishing the required result when constructing a building. It is not so easy, and may be very expensive, to add that capability to an existing building. It is now almost universal practice to use ceiling mounted fluorescent lamps for space illumination in commercial and industrial buildings and, while the invention is not limited to such applications, to control the level of such illumination is an object of the invention. Several approaches to control have been employed in the past. One is to install a separate wall switch and power wiring for each lamp. Another is to add reactive impedance in the energizing circuit of the fluorescent tube and to provide a means for selectively short circuiting the added impedance with separate control wiring or with a toggle switch which toggles in response to actuation of a wall switch. Still another method is to install, at the lamp, a toggle switch that is actuated by pulling on a string that extends down to within reach.

DISCLOSURE OF THE INVENTION

It is a object of the invention to provide an improved method and a means for controlling the level of space illumination;

It is an object of the invention to provide such a method and means which can be incorporated in existing buildings at relatively low cost in labor, and in material, and in lost time of building use.

Another object is to provide an apparatus capable of being mounted in a conventional wall switch box and which permits conversion of a system of the kind in which several lamps are connected to a single on/off control switch for simultaneous energization and de-energization to one which permits on/off control of all or preselected ones of the several lamps.

The advantages of the invention are not limited to retrofitting pre-existing buildings. It is another object to provide an improve method and means for illumination level control in existing buildings.

A further object, to be realized in the case of both new construction and the retrofitting of old construction, is to provide an apparatus which will perform the requisite function safely and reliably and at a cost that permits wide application.

These and other objects and advantages of the invention which will become apparent on examination of the drawings and specification which follows are realized in part by providing a power control switch which toggles from closed to open to closed state in response to actuation of a simple on/off power switch and which can be mounted, if desired, in a conventional electrical box of the kind commonly employed to house such on/off power switches along with the latter.

DESCRIPTION OF THE DRAWINGS

In the drawings:

FIG. 1 is a diagram of a representative illumination installation which incorporates the invention;

FIG. 2 is a circuit diagram of the toggle unit of FIG. 1; and

FIG. 3 is a diagram showing the relation of lamp illumination to power switch operation.

DESCRIPTION OF THE PREFERRED EMBODIMENT

FIG. 1 is a diagram of a generalized system illustrating how the invention is employed in what is now believed to be a major application. Room or space 10 is illuminated, when they are turned on, by a number of fluorescent lamps which lamps are mounted in the ceiling. Four lamps are shown. They are numbered 12, 14, 16 and 18, respectively. Each comprises a ballast transformer, two or more fluorescent tubes connected in parallel, and mounting hardware. Each is of standard commercial manufacture.

The problem solved by the invention is how to arrange for multiple levels of illumination in space 10, to conserve power or otherwise, at a minimum cost in material and labor and, in the case of the modification of existing installations, minimum time and inconvenience. The system of FIG. 1 is based on the assumption that it is desired or required by law to reduce illumination power consumption by half during non-working hours. More particularly, provision is made for having lamps 16 and 18 turned on or off, selectively, while lamps 12 and 14 are turned on. User control of the illumination of all four lamps is accomplished by actuation of a single manually operated wall switch 20. The manually operated switch controls the energization of lamps 12 and 14 directly. It controls the energization of lamps 16 and 18 indirectly by controlling operation of an electrically controlled toggle switch 22. The two switches may be mounted in a common electrical box 24, as indicated in FIG. 1. The numeral 26 indicates that the cover of the box and the actuating lever of the switch 20 are accessible on the wall 28 of room 10. The dashed line 30 represents electrical lines by which electrical power is brought to the box. The other dashed lines represent electrical lines which extend from the box to the lamps 12, 14, 16 and 18.

A wiring diagram of the system is shown in FIG. 2. Here the power line 30 is shown to include two lines 32 and 34 which extend to a power source 36. A second pair of lines 38 and 40 interconnect lines 32 and 34, respectively, with each of lamps 12 and 14 such that the lamps are connected in parallel. A third pair of lines 42 and 44 interconnect lines 32 and 34, respectively, with each of lamps 16 and 18 such that those two lamps are connected in parallel. Switch 20 is connected in series in line 32 at a point between source 36 and lines 36 and 40. The toggle switch 22 is connected in series with line 32 at a point between the junction of that line with lines 36 and 40. Lamps 12 and 14 are energized and illuminated whenever the manually operated wall switch 20 is closed whether or not the toggle switch is closed. On the other hand, lamps 16 and 18 are energized and illuminated only when both of switches 20 and 22 are closed.

Switch 22 toggles as a consequence of the operation of switch 20. That is, switch 22 is constructed so that its state alternates between on and off, closed or open, in response to actuations of switch 20 to apply or remove energy from its actuating structure. It may be actuated to change state with application of energy, with each cessation of energy supply or with each change in the state of the energy supply. It may employ an electrical actuating structure or an electromagnetic structure or another kind. The preferred embodiment, the one shown in FIG. 3 of the drawing, employs an electro-optical structure.

FIG. 3 is a schematic diagram of a preferred form of the structure represented by the switch symbol 22 of FIG. 2. It includes a bi-directional semiconductor device 46, a triac, in line 32 which is rendered conductive when a positive potential is applied to its control electrode 48. Except for the other power line, the remainder of the apparatus of FIG. 3 is devoted to responding to change in the energization of lines 32 and 34. Device 50 is a "D" type, edge triggered, flip-flop the terminals of which are numbered as they are in the dual flip-flop package unit type 7474. The power supply terminals are 14, positive, and 7, negative. Clear terminal 1 and set terminal 4 are tied to positive supply in normal operation. The potential at Q output terminal 5 corresponds to the potential at the D terminal 2 at the time the clock terminal 3 last went high, or positive in this case. The output at the NOT Q pin 6 is always the complement of the output at Q pin 5. Pin 6 is connected to D pin 2 by line 52. Therefore. The output at pins Q and NOT Q reverses each time the clock pin 3 goes positive after having been low or negative.

The type 7474 device employs transistor-transistor logic powered with direct current at a potential of five volts. In this embodiment that potential is developed in a voltage divider-rectifier network formed by the combination, in series with dropping resistor 54 from line 34 to line 32, of the parallel combination of three series circuits formed by resistor 56 and diode 58, resistor 60 and diode 62, and resistor 64 and diode 66, respectively. Filter capacitors 68, 70 and 72 are connected in parallel with resistors 56, 60 and 64, respectively. The positive potential for application to pins 1 and 14 of the flip-flop is developed across resistor 56 and capacitor 68. The potential for application to set pin 4 is developed across resistor 64 and capacitor 72. The time constant for discharge of capacitors 68 and 72 through resistors 56 and 64, respectively, is set quite long relative to the time constant for discharge of capacitor 70 through resistor 60. The result is that positive potentials are applied to pins 1, 14 and 7 for a longer time after de-energization of lines 32 and 34 than to clock pin 3. The result is that application of energy to lines 32 and 34 results in change from low to high signal on pin 3 when lies 32 and 34 are energized but only after they have been de-energized for a time determined by the time constant of the combination of resistor 60 and capacitor 70.

The light emitting diode 72 of an optical coupler 74 is connected between the Q and NOT Q terminals 5 and 6 of the flip-flop 50. A double pole, double throw switch 76 is wired to permit reversal from the connection shown in which the anode and cathode of the diode are connected to NOT Q and Q, respectively, to the connection in which they are connected to Q and NOT Q, respectively. When switch 76 is in the condition shown. The diode 72 emits light when Q is high. If switch 76 is in the opposite condition, diode 72 emits light when Q is low. Light from the diode is directed to a semiconductor 74 which generates a potential when subjected to light. The semiconductor 74 is connected such that its negative side is connected to line 32 and its positive side is connected to control electrode 48 of the triac. When diode 72 emits light, the triac is turned on. When the diode 72 is dark, the triac is turned off.

Operation of the circuit of FIG. 3 is described as follows assuming that it is connected at the point of switch 22 of FIG. 2 and that switch 76 is arranged to connect the anode of diode to output Q, as shown.

Operation of the system is illustrated graphically in FIG. 4. The upper graph depicts actuation of the switch 20 of FIG. 1 and the state of illumination of lamps 12 and 14. "ON" means that switch 20 is closed and that the lamps are illuminated. "OFF" means that the switch 20 is open and the lamps 12 and 14 are not illuminated. The intermediate graph shows the state of illumination of lamps 16 and 18 when switch 76 has the state shown whereby the cathode of diode 72 is connected to output Q. The lower graph of FIG. 4 illustrates the state of illumination of the lamps 16 and 18 when the switch 76 has the opposite state. In the intermediate and lower graphs, "ON" means lamps 16 and 18 are illuminated. "OFF" means they are not. The time scale along the X axis is applicable to all three graphs. Assume that switch 20 has been open or OFF for a time long enough for capacitors 68, 70 and 72 to be completely discharged. It will be understood from an examination of FIG. 2 that none of lamps 12, 14, 16 or 18 are illuminated in that circumstance. That condition continues from time 0 to time 1. At time 1 switch 20 is turned on. In FIG. 2 lamps 12 and 14 will be illuminated. In FIG. 3, capacitors 68, 70 and 72 are immediately charged and operating potentials are applied to flip-flop 50. The flip-flop "awakes" with the Q output high. Thus diode 72 is turned on. A voltage appears across the output semiconductor 78 which voltage is applied to control electrode 48 of the triac 46. The triac is turned on, power is applied to lamps 16 and 18 and they are illuminated as indicated by the intermediate graph of FIG. 4.

At time 2 the switch 20 is opened and it remains open until time 4. Lamps 12 and 14 turn of with switch 20. The capacitors 68 and 72 of switch 22 discharge slowly and the diode 72 remains on until time 3. Thus a positive potential is applied to control electrode 48 until time 3 but no current flows through the triac because switch 20 is open whereby lamps 16 and 18 are turned off at time 2. Thus switch 20 is effective to turn all four lamps on and off as is usual with light switches.

At time 4 the switch 20 is again turned ON. All of the lamps are illuminated as before. At time 5, the switch 20 is turned OFF and all lamps are turned OFF as before. In switch 22 of FIG. 3, capacitor 70 discharges more rapidly than do capacitors 68 and 70. Thus the clock pin 3 goes low while the flip-flop 50 is still energized and operative with its Q output pin high and it's NOT Q and D pins low. At time 5, while clock pin 3 is low and D pin is low, the switch 22 is turned ON. Capacitor 70 is recharged, clock pin 3 goes high and output Q flips to low state. Diode 72 turns off. No voltage is developed in semiconductor 78 and triac 46 is turned off. Lamps 16 and 18 turn OFF while lamps 12 and 14 remain ON. That condition will continue until switch 20 is again turned off. Proper operation requires that the discharge time of capacitors 68 and 72 be longer than the time in which a user would normally operate switch 20 from ON to OFF to ON for the purpose of causing a reduction in illumination level. The time delay at clock pin 3 need only be long enough to prevent contact bounce at switch 20 from changing flip-flop state.

If the lower level of illumination is to be normal the state of switch 76 may be reversed so that the diode 72 is dark when the flip-flop "awakes" on first closure of the switch 20. The state of the flip-flop outputs will not change until the second time that the switch 20 is turned on within a time interval of predetermined duration. That interval is shorter than the interval between times 2 and 4. It is longer than the interval between times 5 and 6. Therefore, at shown in the lower graph of FIG. 4, lamps 16 and 18 are turned on at the next turn on actuation of switch 20.

Switch 76 would be included as shown if it was desired to have the facility to change between the CN-OFF operation of the intermediate graph to the OFF-ON operation of the lower graph. If that facility was not required, switch 76 would be omitted and the circuit hard wired for one type of operation or the other.

In accordance with the rules, the best mode now known for practicing the invention has been shown in the accompanying drawing and described in the specification above. However, it is to be understood that other embodiments and variations of the invention are possible and that the invention is to be limited by what is defined in the appended claims rather than by what has been shown.

I claim:

1. A fluorescent tube lighting system comprising, in combination:

a plurality of fluorescent lamps;

an energizing circuit for supplying electrical energy to said lamps in parallel from a common source;

a first switch and a second switch, each of said switches being effective in one state of actuation to interrupt, and in another state of actuation not interrupt, a circuit in which connected;

said first switch being connected in series in said energizing circuit with each of said lamps;

said second switch being connected in series in said energizing circuit with less than all of said lamps; and said second switch being responsive to a predetermined change in the state of said first switch to change the state of said second switch in that said second switch is responsive to change state from said one state to said other state in response to the second change of state from said one to said other state in said first switch provided that the second change of state in the first switch occurs within a predetermined time interval following a preceeding change of state in said first switch.

2. A fluorescent tube lighting system comprising, in combination:

a plurality of fluorescent lamps;

an energizing circuit for supplying electrical energy to said lamps in parallel from a common source;

a first switch and a second switch, each of said switches being effective in one state of actuation to interrupt, and in another state of actuation not interrupt, a circuit in which connected;

said first switch being connected in series in said energizing circuit with each of said lamps;

said second switch being connected in series in said energizing circuit with less than all of said lamps; and said second switch being responsive to a predetermined change in the state of said first switch to change the state of said second switch;

said second switch being ineffective to change from said one to said other state as an incident to change in said first switch from said one to said first state unless occurring within a predetermined time interval following change in said first switch from said other to said one state.

3. A fluorescent tube lighting system comprising, in combination:

a plurality of fluorescent lamps;

an energizing circuit for supplying electrical energy to said lamps in parallel from a common source;

a first switch and a second switch, each of said switches being effective in one state of actuation to interrupt, and in another state of actuation not interrupt, a circuit in which connected;

said first switch being connected in series in said energizing circuit with each of said lamps;

said second switch being connected in series in said energizing circuit with less than all of said lamps;

said second switch being responsive to a predetermined change in the state of said first switch to change the state of said second switch; and which further comprises an electrical wall mounted box, both of said first and second switches being mounted in said wall box.

4. The method of providing for altering the amount of energy consumed in illuminating a space with fluorescent lamps with the aid of an ON-OFF wall switch which method comprises the steps of:

mounting a plurality of fluorescent lamps in position to light a space bounded by a wall;

mounting an ON-OFF switch on said wall in position for manual actuation;

installing electrical energy conductors from a point at which electrical energy is available to said wall switch and from said switch to at least a first lamp of said plurality of lamps and from said wall switch to at least a second lamp of said plurality of lamps such that said wall switch is connected in series circuit with the electrical conductors leading to said first and second lamps; and installing a second switch at a point in said electrical energy conductors, and in series circuit therewith, between said wall switch and said second lamp;

said second switch comprising an electrically actuated toggle switch operative in response to actuation of said wall switch;

said toggle switch being effective to supply energy to said second lamp only after said first switch is twice actuated to supply energy to said first lamp and the second of said actuations occurs within an interval of predetermined duration following actuation of said first switch to terminate the supply of energy to said first lamp.

5. A fluorescent tube lighting system comprising, in combination:

a plurality of fluorescent lamps;

an energizing circuit for supplying electrical energy to said lamps in parallel from a common source;

a first switch and a second switch, each of said switches being effective in one state of actuation to interrupt, and in another state of actuation not interrupt, a circuit in which connected;

said first switch being connected in series in said energizing circuit with each of said lamps;

said second switch being connected in series in said energizing circuit with less than all of said lamps; and said second switch being responsive to a predetermined change in the state of said first switch to change the state of said second switch;

said toggle switch comprising a flip-flop and means for storing electrical energy during periods when said first switch has said first state and for using the energy so stored to maintain said flip flop operative for a predetermined interval following actuation of said first switch to said other state.

* * * * *